United States Patent [19]

Miller et al.

[11] 4,413,367

[45] Nov. 8, 1983

[54] CONFINING FRAME FOR WATER BED

[75] Inventors: Paul S. Miller, Collinsville, Ill.; Michael J. Rossi, 545 Buena Vista, Edwardsville, Ill. 62025

[73] Assignee: Michael J. Rossi, Belleville, Ill.

[21] Appl. No.: 389,095

[22] Filed: Jun. 16, 1982

Related U.S. Application Data

[63] Continuation of Ser. No. 103,046, Dec. 13, 1979, abandoned.

[51] Int. Cl.[3] ..... A47C 27/08; A47C 19/00

[52] U.S. Cl. ..... 5/411; 5/200 R; 5/451

[58] Field of Search ..... 5/451, 452, 400, 401, 5/402, 200 R, 201, 411

[56] References Cited

U.S. PATENT DOCUMENTS

| | | | |
|---|---|---|---|
| 3,585,660 | 6/1971 | Gottfried et al. | 5/451 |
| 4,077,074 | 3/1978 | Fogel | 5/451 |
| 4,128,907 | 12/1978 | Gelbart | 5/201 |

*Primary Examiner*—Alexander Grosz
*Attorney, Agent, or Firm*—Rogers, Eilers & Howell

[57] ABSTRACT

Portions of the confining frame of a water bed are made so they can be tilted away from the water-filled mattress of that water bed to facilitate the positioning, and the smoothing, of a cover for that water-filled mattress adjacent the sides and end of that water-filled mattress.

10 Claims, 9 Drawing Figures

CONFINING FRAME FOR WATER BED

This application is a continuation of application Ser. No. 103,046, filed Dec. 13, 1979, now abandoned.

BACKGROUND OF THE INVENTION

Water beds are finding wider acceptance and use. However, one drawback to the acceptance and use of water beds is the difficulty of positioning, and smoothing, portions of the covers for those water beds between the sides and feet of the water-filled mattresses and the sides and feet of the confining frames of those water beds. More particularly, the contents of the water-filled mattresses of water beds continually urge the sides and feet of those mattresses against the inner surfaces of the sides and feet of the confining frames of those water beds; and a person's fingernails can be cracked or broken, and a person's fingers and hands can be abraded or scratched, during the positioning, and smoothing, of the covers between the sides and feet of those mattresses and the sides and feet of those frames.

SUMMARY OF THE INVENTION

The present invention facilitates the positioning and smoothing of portions of a cover, between the sides and foot of a water-filled mattress and the sides and foot of a confining frame of a water bed, by making the upper portions of the sides and foot of that frame tiltable outwardly away from that mattress. As a result, the fingers and hands of a person, positioning and smoothing portions of a cover which are in register with the sides and foot of the water-filled mattress, will not have to be pushed down between those sides and foot and the inner surfaces of the sides and foot of the confining frame of the water bed. Instead, those fingers and hands will have the same freedom in positioning and smoothing those portions of the cover which the fingers and hands of persons "making" a bed with a standard mattress have. Once the portions of the cover have been positioned and smoothed, the upper portions of the sides and foot of the retaining frame will be returned to their normal mattress-confining position; and thereafter they will provide full lateral support for that mattress. It is, therefore, an object of the present invention to provide a confining frame for a water bed which has the upper portions of the sides and foot thereof movable away from the sides and foot of the water-filled mattress to facilitate the positioning and smoothing of portions of the cover for that mattress.

Other and further objects and advantages of the present invention should become apparent from an examination of the drawing and accompanying description.

In the drawing and accompanying description several preferred embodiments of the present invention are shown and described, but it is to be understood that the drawing and accompanying description are for the purpose of illustration only but do not limit the invention and that the invention will be defined by the appended claims.

DETAILED DESCRIPTION OF PREFERRED EMBODIMENTS

Figures 1, 2, 3, 8, 9:
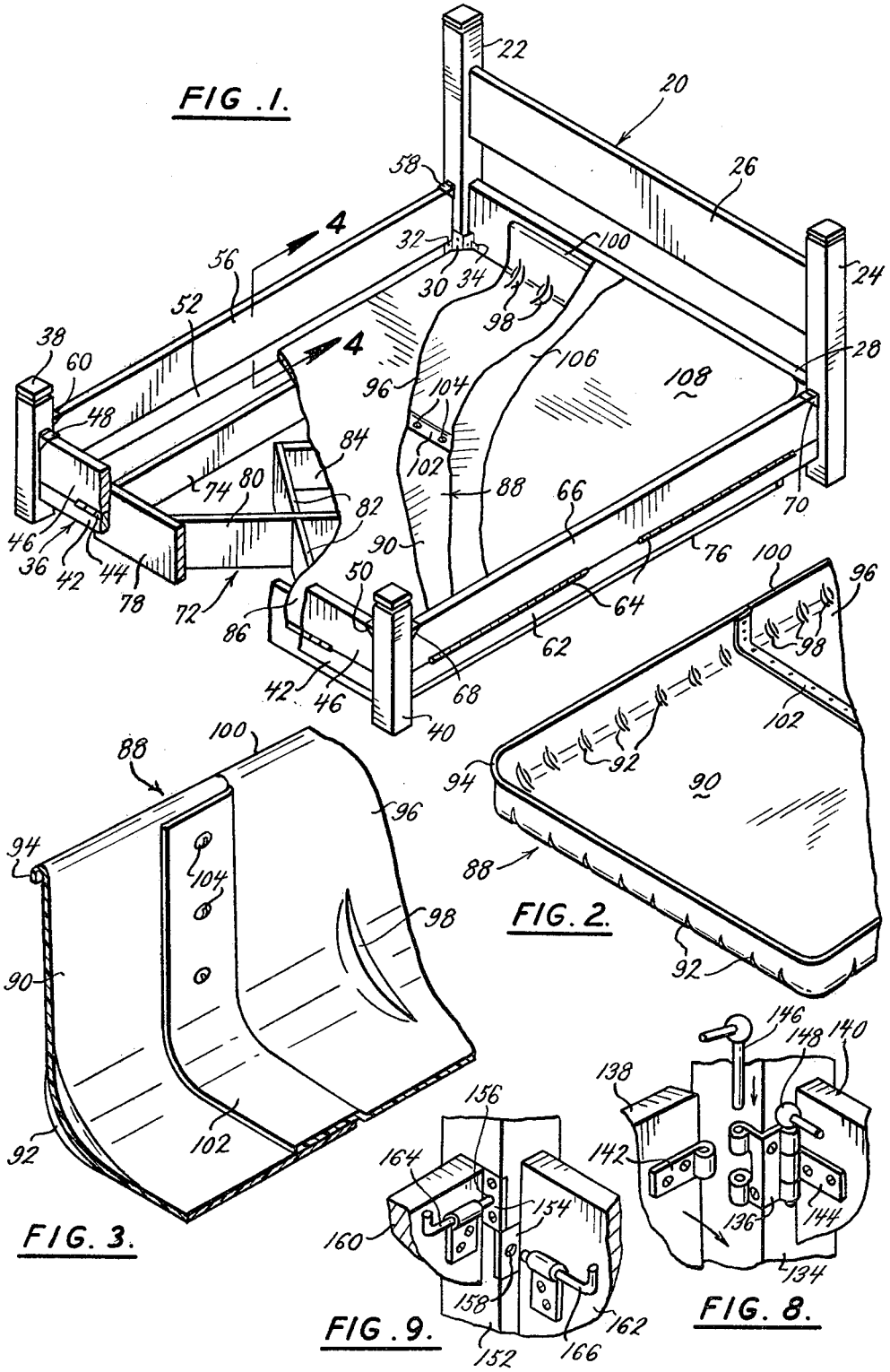
FIG. 1 is a partially broken-away perspective view of one embodiment of water bed incorporating the principles and teachings of the present invention.
FIG. 2 is a perspective view of part of a protective enclosure for the water-filled mattress of the water bed of FIG. 1.
FIG. 3 is a perspective sectional view, on a larger scale, of a portion of the protective enclosure of FIG. 2.
FIG. 8 is a perspective view of a portion of the footboard and one of the rails of a third embodiment of water bed incorporating the principles and teachings of the present invention.
FIG. 9 is a perspective view of a portion of the footboard and one rail of a fourth embodiment of water bed incorporating the principles and teachings of the present invention.

Referring to the drawing in detail, the numeral 20 generally denotes the headboard of one preferred embodiment of water bed that is made in accordance with the principles and teachings of the present invention. That headboard includes vertical posts 22 and 24 which are held in spaced-apart relation by vertically-displaced-horizontally-directed spacing members 26 and 28. The headboard 20 and its posts 22 and 24 and its horizontally-directed spacing members 26 and 28 can be of standard and usual design; because they are not, per se, parts of the present invention.

Figure 5:
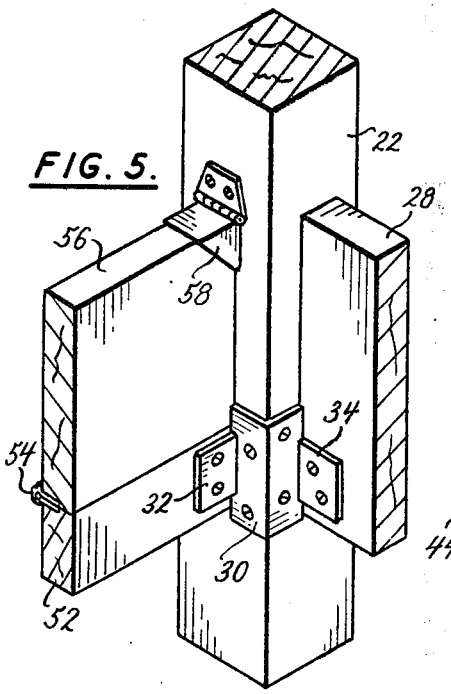
FIG. 5 is a perspective sectional view, on a scale intermediate those of FIGS. 1 and 5, of a portion of a headboard and of one of the rails of the water bed of FIG. 1.

The numeral 30 denotes an L-shaped bracket with laterally-extending wings 32 and 34. As shown particularly by FIG. 5, screws are used to secure that L-shaped bracket to two of the faces of the post 22 adjacent the lower edge of the horizontally-directed spacing member 28. Also, as shown by FIG. 5, screws secure the wing 34 of that bracket to that horizontally-directed spacing member.

The numeral 36 generally denotes the footboard of the water bed of FIG. 1; and that footboard includes posts 38 and 40 which can be of standard and usual design. The numeral 42 denotes a horizontally-directed spacing member which is rigidly secured to the posts 38 and 40, as by an L-shaped bracket 49 which is equipped with wings 51 and 53 and by an identical wing-equipped L-shaped bracket, not shown. Screws secure L-shaped bracket 49 to the post 38; and further screws secure the wing 51 to the horizontally-directed spacing member 42. Although the wing-equipped L-shaped bracket 49 has been found to be quite strong and usable, additional or alternate securing devices can be provided to fixedly secure the horizontally-directed spacing member 42 to the post 38. Similarly, although the wing-equipped L-shaped bracket 30 has been found to be quite strong and usable, additional or alternate securing devices can be provided to fixedly secure the horizontally-directed spacing member 28 to the post 22. Further, wing-equipped L-shaped brackets, or further additional or alternate securing devices, not shown, will secure horizontally-directed spacing member 28 to post 24 and horizontally-directed spacing member 42 to post 40. As a result, the posts 22 and 24 will coact with horizontally-directed spacing member 28, with L-shaped bracket 30 and a further L-shaped bracket or additional or alternate securing devices, and with horizontally-directed spacing member 26 to constitute a sturdy and rugged head board. Similarly, the posts 38 and 40 will coact with horizontally-directed spacing member 42, with L-shaped bracket 49 and a further L-shaped bracket or additional or alternate securing devices and with horizontally-directed spacing member 42 to constitute a sturdy and rugged foot board.

The numeral 44 denotes a hinge which is secured to the horizontally-directed spacing member 42, and which also is secured to an elongated board-like foot member 46. That hinge can be a piano or other elongated hinge, can be sections of a piano or other elongated hinge, or can consist of a number of short, spaced-apart hinges. The hinge 44 must permit the foot member 46 to normally occupy the position shown by FIGS. 1 and 6, wherein it is in a plane that is defined by the horizontally-directed spacing member 42; but that hinge must permit that foot member to be pivoted outwardly away from that plane.

The numeral 48 denotes a pivoted latch which has a securing portion that is fixedly secured to the post 38, and which also has a U-shaped portion with generally-triangular sides that is pivoted to that securing portion. That U-shaped portion can be raised upwardly to clear the upper edge of the foot member 46, or it can be moved into the position shown by FIGS. 1 and 6 wherein its sides are in register with the inner and outer faces of the upper portion of the left-hand end of that foot member. An identical pivoted latch 50 has the securing portion thereof fixedly secured to the post 40, and has the U-shaped pivoted portion thereof selectively movable between raised and lowered positions. In its upper position, that U-shaped portion will free the upper portion of the right-hand end of the foot member 46; but in its lower position, that U-shaped portion will confine that upper portion of that right-hand end.

Figure 6:
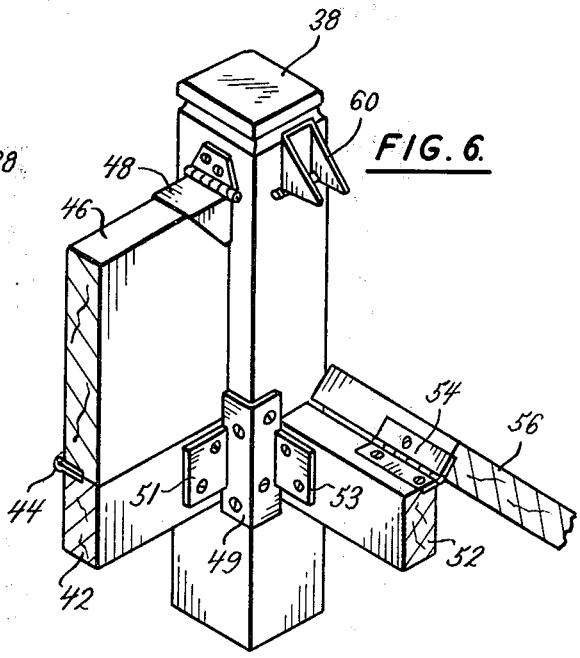
FIG. 6 is a perspective sectional view, on the scale of FIG. 5, of a portion of the footboard and of the one rail of the water bed of FIG. 1.

The numeral 52 denotes a board-like rail which has one end thereof fixedly secured to the post 22 of the headboard 20 by screws and the wing 32 of the L-shaped bracket 30, as shown by FIG. 5. That rail has the other end thereof fixedly secured to the post 38 of the footboard 36 by screws and the wing 53 of the L-shaped bracket 49, as shown by FIG. 6. The numeral 54 denotes a hinge which pivotally secures a board-like side member 56 to the rail 52. That hinge can be a piano or other elongated hinge, can be sections of a piano or other elongated hinge, or can consist of a number of short, spaced-apart hinges. The hinge 54 must permit the side member 56 to normally occupy the position of FIGS. 1, 4 and 5, wherein it is in a plane defined by the rail 52; but that hinge must permit that side member to be pivoted outwardly away from that plane, as indicated by FIG. 6.

The numeral 58 denotes a pivoted latch which is identical to the latch 48; and the securing portion thereof is fixedly secured to the post 22, and the U-shaped portion thereof selectively frees or confines the right-hand end of the upper portion of side member 56. The numeral 60 denotes a further pivoted latch which is identical to the latch 48; and the securing portion thereof is fixedly secured to the post 38, and the U-shaped portion thereof selectively frees or confines the left-hand end of the upper portion of side member 56. When the U-shaped portions of the pivoted latches 58 and 60 are in their upper positions, they free the side member 56 for movement from the position of FIGS. 1, 4 and 5 to the position of FIG. 6. However, when those U-shaped portions are in the lower positions of FIG. 1, they can hold the side member 56 in the normal position shown by FIGS. 1, 4 and 5.

The numeral 62 denotes a rail which can be identical to the rail 52; and that rail is fixedly secured to the posts 24 and 40, of the headboard 20 and footboard 36, respectively, by screws and the wings of wing-equipped L-shaped brackets, not shown, which are secured to those posts. A hinge 64 secures a board-like side member 66 to the rail 62. That hinge can be an elongated piano or other elongated hinge, can be sections of a piano or other elongated hinge, or can consist of a number of short, spaced-apart hinges. The hinge 64 must permit the side member 66 to normally occupy the position of FIG. 1, wherein it is in a plane defined by the rail 62; but that hinge must permit that side membrer to be pivoted outwardly away from that plane. Pivoted latches 68 and 70 are identical to the pivoted latch 48; and the securing portions of those latches are fixedly secured, respectively, to the post 40 and the post 24. The U-shaped portions of those latches will normally hold the side member 66 in the position shown by FIG. 1; but they can be moved upwardly to free that side member for movement outwardly away from the plane defined by the rail 64.

The numeral 72 generally denotes a rectangular supporting frame which is intended to underlie, and to support the wieght of, the water-filled mattress 106 of the water bed. That frame includes a side member 74 which is shorter than the rail 52 and which is spaced several inches inwardly of the plane defined by the rail. The numeral 76 denotes a further side member which defines the opposite side of the frame 72. That side member is shorter than the rail 62; and it is spaced several inches inwardly of the plane defined by that rail. The numeral 78 denotes one of the end members of the frame 72; and it is shorter than the horizontally-directed spacing member 42, and is spaced several inches inwardly of the plane which is defined by that horizontally-directed member. A further end member, not shown, is identical to the end member 78; and it constitutes the other end member of frame 72. The further end member is shorter than, and is spaced several inches inwardly of the plane which is defined by, the horizontally-directed spacing member 28. The side members 74 and 76, the end member 78, and the further end member, not shown, are set on edge; and they will rest upon the floor, carpet or other supporting surface of the room in which the water bed is used. Angularly-positioned members 80, 82 and 84 are set on edge and are fixedly connected to the said spaced-apart end members of the frame 72. Further angularly-positioned members, not shown, are set on edge and are fixedly secured to those spaced-apart end members. The angularly-positioned members 80, 82 and 84, and the further angularly-positioned members, not shown, coact with side members 74 and 76, end member 78, and the further end member, not shown, to make the rectangular supporting frame 72 sturdy and rugged. That rectangular supporting frame is of standard and usual design and is not, per se, part of the present invention.

The numeral 86 denotes a supporting platform which overlies and projects laterally beyond both sides and both ends of the rectangular supporting frame 72. That platform is very similar to, but is an inch or more longer and an inch or more wider than, a standard supporting platform for a water bed. For example, if the standard supporting platform for a water bed is six feet wide and seven feet long, the platform 86 will be six feet and one inch wide and seven feet and one inch long. That platform will be made of the same kind, thickness and weight of plywood that is used in making standard supporting platforms for water beds. Dowel pins, or other fastening members, not shown, are passed through openings in platform 86 and seat in sockets in various members of the rectangular supporting frame 72 to keep that platform from shifting relative to that frame. That platform has the sides and ends thereof confronting, and has at least one of those sides or ends engaging one of, the inner faces of rails 52 and 62 and horizontally-directly spacing members 42 and 28. As a result, the frame 72 and the platform 86 will coact with the headboard 20, the footboard 36, and the side rails 52 and 62 to fixedly hold the water bed in position.

The numeral 88 generally denotes an open-top protective enclosure which is intended to rest upon the platform 86, and hence upon the frame 72, within the confining frame constituted by the horizontally-directed spacing member 28, the hinged foot member 46, and the hinged side members 56 and 66. That protective enclosure is made as two halves 90 and 96; each of which has upstanding side walls and end walls. Reinforcing ridges 92 are formed in the fillet-like portion of the half 90 which is intermediate the planar bottom and the upstanding sides of that half. The numeral 94 denotes an outwardly and downwardly bent upper edge for that half that is smooth and free of any "flash" which could develop as that half is molded. Reinforcing ridges 98 are formed in the fillet-like portion of the half 96 which is intermediate the planar bottom and the upstanding sides of that half. The numeral 100 denotes an outwardly and downwardly bent upper edge for the half 96 that is smooth and free of any "flash" which could develop as that half is molded. The numeral 102 denotes an upwardly-offset edge which is provides at the planar bottom and at the upstanding sides of the free end of the half 96, as shown particularly by FIGS. 2 and 3. That upwardly-offset edge overlies the open end of the half 90; and fasteners 104 are used to secure that upwardly-offset edge to that open end. By providing a suitable sealant or cement intermediate the upwardly-offset edge 102 and the underlying free end of the half 90, the two halves 90 and 96 are enabled to constitute an enclosure which can confine and hold water. That enclosure will be able to confine and hold most of the water in the water-filled mattress 106 in the event a leak develops in that mattress. Also, that enclosure will provide lateral support for the sides of the water-filled mattress. The ridges 92 and 98 are made so they are smoothly rounded and are free of sharp edges. As a result, those ridges will not form or create leaks in the mattress 106.

The water-filled mattress 106 can be of standard and usual design and construction; and, where that is the case, the protective enclosure 88 will have inner dimensions that are essentially the same as the inner dimensions of the confining frame of a water bed of standard and usual construction. However, if desired, the water-filled mattress 106 could be made larger or smaller than water-filled mattresses of standard dimensions; and, in such event, the protective enclosure 88 would be made correspondingly larger or smaller. Where the water-filled mattress 106 is of standard and usual design, it will be substantially dimensionally-stable, in that it will have generally-vertical sides when it is filled with water but no one is resting upon it.

Figure 4:
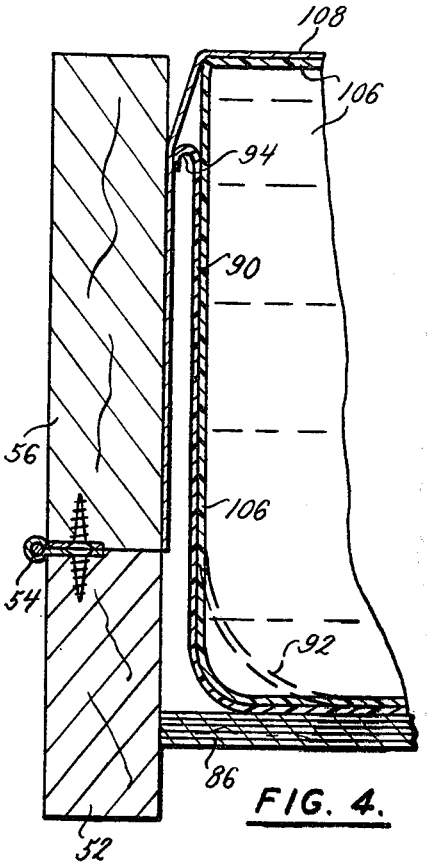
FIG. 4 is a sectional view, on a still larger scale, and it is taken along the plane indicated by the line 4—4 in FIG. 1.

In using the water bed of FIG. 1, the protective enclosure 88 is disposed so the planar bottom of the halves 90 and 96 thereof rest upon the supporting platform 86, and so the outwardly and downwardly bent edges 94 and 100 of those halves are in confronting relation with the horizontally-directed spacing member 28 of headboard 20, with the foot member 46, and with the side members 56 and 66. As indicated by FIG. 4, the outwardly and downwardly bent edges 94 and 100 of the halves 90 and 96 of the enclosure 88 are disposed short distances below the upper edges of horizontally-directed spacing member 28, of foot member 46, and of side members 56 and 66. Also, as indicated by FIG. 4, the top of the water-filled mattress 106 is essentially at the level of those upper edges.

The outwardly and downwardly bent upper edges 94 and 100 of the halves 90 and 96 of the enclosure 88 are so close to the inner surfaces of the horizontally-directed spacing member 28, of the foot member 46, and of the side members 56 and 66 that a person's hands and fingers can not pass between those edges and those inner surfaces. However, to dispose the sides and lower end of a cover 108 between the edges 94 and 100 and the inner faces of side members 56 and 66 and of foot member 46, it is a simple matter to rotate the pivoted latches 58 and 60 upwardly to permit the side member 56 to move outwardly away from the edges 94 and 100. Those latches are readily movable to their upper positions; and there will be sufficient frictional foces between the U-shaped portions and the pivots of those latches to cause those U-shaped portions to remain in those upper positions until they are moved down to the positions of FIG. 1. While those latches are in their upper positions, the side member 56 can be pivoted outwardly and downwardly until the left-hand side of the mattress 106 is fully exposed. Similarly, the latches 48 and 50 can be set in their upper positions so the foot member 46 can be pivoted outwardly and downwardly to fully expose the foot of mattress 106; and the latches 68 and 70 can be set in their upper positions so the side member 66 can be pivoted outwardly and downwardly to fully expose the right-hand side of that mattress. At such time, the lateral thrust of the water within the mattress 106 will bow the upper portions of the sides and end of that mattress outwardly; but that bowing will be limited in extent, because the sides and foot of the protective enclosure 88 confine the major portions of the sides and foot of that mattress.

At this time, the cover 108 may directly overlie the water-filled mattress 106 or may overlie a bed pad which rests atop that mattress. That cover can be a bottom sheet, can be a bottom sheet plus an upper sheet, can be a bottom sheet plus an upper sheet and a blanket or bedspread, or can be any desired combination of sheets, blankets, comforters and bedspreads. Where that cover includes more than one element, the lowermost element will usually be positioned atop the mattress 106 and will have the sides and foot end thereof smoothed before the next element is positioned atop that mattress. By having foot member 46 and side members 56 and 66 movable to positions wherein full and free access can be had to all portions of the side and foot of protective enclosure 88 and to the upper portions of the sides and foot of mattress 106, the present invention makes it very easy to position the cover 108 and to smooth its sides and foot. Those sides and that foot preferably will be dimensioned or folded to hang down close to the level of hinges 54, 44 and 64. Where that is done, ay needed smoothing of the sides and foot of cover 108 is easily accomplished. Thereafter, the side members 56 and 66 and foot member 46 can be moved back to, and latched in, the positions shown by FIG. 1. At that time, the inner faces of those side members and foot member will apply light frictional forces to those portions of cover 108 which are interposed between those inner faces and the edges 94 and 100 of enclosure 88. Those frictional forces will be light enough so the sides or foot of that cover can be pulled upwardly without tearing them, but will be heavy enough to resist undesired movement of those sides or foot.

Figure 7:
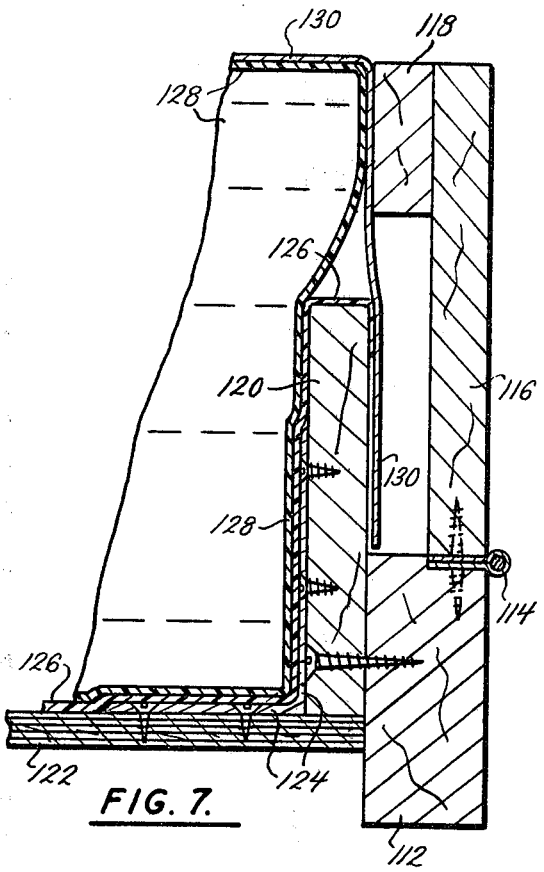
FIG. 7 is a vertical section through a portion of a second embodiment of water bed incorporating the principles and teachings of the present invention.

Referring particularly to FIG. 7 the numeral 112 denotes an alternate form of rail which can be substituted for the rail 62. A hinge 114 secures a side member 116 to the rail 112; and that hinge can be identical to the hinge 64. However, the side member 116 differs from the side member 66 in having a recessed area at the inner face thereof. Specifically, a spacer 118 is secured to, and movable with, the upper edge of the side member 116; and a recessed area is below that spacer. A stationary spacer 120 is secured to the inner face of the rail 112; and the upper edge of that spacer is located a short distance below the level of the lower edge of movable spacer 118. As a result, the recessed area at the inner face of the lower portion of side member 116 communicates with the area above the spacer 120. As indicated by FIG. 7, the side of a cover 130 can extend through the elongated opening, defined by the lower edge of movable spacer 118 and the upper edge of stationary spacer 120, to be lodged within the recessed area at the lower portion of the inner face of side member 116. That side of that cover will be dimensioned or folded to hang down close to the level of hinge 114.

The numeral 122 denotes the supporting platform for the waterbed of FIG. 7; and a number of sturdy L-shaped metal brackets 124, of standard and usual design, are used to help hold the spacer 120 in vertical position. The other rail and side member of the water bed, and the horizontally-directed member and movable foot member of the foot board preferably will be made in the manner shown by FIG. 7. Where that is done, the spacer 120 and the corresponding spacers of the other side member and of the foot member will coact with the lower horizontally-directed spacing member of the head board to constitute the confining frame for the lower portion of a water-filled mattress 128 for the water bed. The spacer 118 and the corresponding spacers on the other side member and on the foot member will coact with the lower horizontally-directed spacing member of the head board to confine the upper portions of that mattress.

The numeral 126 denotes a continuous sheet of thin imperforate plastic which is large enough to completely cover the platform 122 and to cover the inner faces and the tops and parts of the outer faces of spacer 120 ad of the corresponding stationary spacers of the other side member and foot member. Also, that sheet of thin plastic is made long enough to extend up the full height, and to overlie the top and part of the outer face, of the lower horizontally-directed spacer member of the head board. That sheet of thin plastic is intended to perform the function of holding any water which might leak from the water-filled mattress 128.

In using the water bed of FIG. 7, it is only necessary to rotate the side member 116, its counterpart side member, and the corresponding foot member outwardly to provide full access to the upper portion of the sides and foot of the water-filled mattress 128. Thereupon, the cover 130 can be positioned atop that mattress and can have the sides and foot thereof smoothed. As indicated by FIG. 7, those sides and that foot will extend downwardly along the outer faces of stationary spacer 120, of the counterpart spacer adjacent the other side member, and of the stationary spacer adjacent the foot member. Thereafter, the side member 116, its counterpart side member, and the movable foot member will be moved up to their vertical positions to enable the spacers 118 at the inner surfaces of the upper portions thereof to confine the upper portions of the mattress 128. Suitable latches, not shown, will be provided adjacent the opposite ends of side member 116, of the counterpart side member, and of the movable foot member. The spacers 118 will apply light frictional forces to those portions of cover 130 which are interposed between those spacers and the upper portions of the sides and foot of mattress 128. Those frictional forces will be light enough so the sides or foot of that cover can be pulled upwardly without tearing them, but will be heavy enough to resist undesired movement of those sides or foot.

If desired, the water bed of FIG. 1 could be used without the protective enclosure 88, as by providing a large thin plastic sheet such as the large thin plastic sheet 126. Such a water bed would be less expensive than the water bed of FIG. 1 or the water bed of FIG. 7. However, the side portions and the foot portion of that large plastic sheet would have to be flexed between normal positions, wherein they would be held vertical by the side members 56 and 66 and by the foot member 46, and outer positions wherein they would drape along the outwardly-directed side members 56 and 66 and the foot member 46. Also, the corners of that large flexible sheet would have to flex as those side members and foot members were moved from their normal raised positions to their outer positions, and were again raised to their normal positions. However, where a large plastic sheet of plastic was used which would be able to withstand repeated flexing, and particularly where that large plastic sheet was provided with accordion-like corners, such a sheet could be substituted for the protective enclosure 88. For convenience, the sides and foot of that plastic sheet could be taped, cemented, stapled or otherwise secured to side members 56 and 66 and to foot member 46.

Where a large plastic sheet is substituted for the protective enclosure 88, the sides and foot of the mattress 106 will bow outwardly when the side members 56 and 66 and the foot member 46 are moved outwardly away from the sides and foot of that mattress. However, that bowing will not be excessive. because only the weight of the cover 108 will be resting on that mattress. Afer the sides and foot of that cover have been positioned and smoothed, those side members and that foot member will be returned to the position of FIG. 1 to confine the sides and foot of mattress 106.

Although those side members and that foot member would restore the sides and foot of the water-filled mattress 106 to their normal essentially-planar configurations, as those side members and that foot member were moved into and latched in, the vertical positions of FIG. 1, the water within that mattress would resist such restoration. For example, where a water bed is made with a platform 86 that is six feet wide and seven feet long, and where a large plastic sheet is used instead of a protective enclosure 88, a force of approximately forty (40) pounds is required to restore the side member 56 or the side member 66 to its vertical position when the foot member 46 and the other of those side members have previously been restored to their vertical positions. Essentially no force is required to restore any of the members 56, 66 or 46 to its vertical position where the water-filled mattress 106 is confined by the protective enclosure 88. Very little force is required to restore the side member 116, its counterpart side member, or the foot member of the water bed of FIG. 7 to their vertical positions.

By making the platform 86 one inch longer and one inch wider, while using the same mattress 106, the present invention materially reduces the force which is needed to restore the side member 56 or the side member 66 or the foot member 46 to the position of FIG. 1—even where a thin plastic sheet is substituted for the protective enclosure 88. Specifically, by increasing the length of platform 86 from seven feet to seven feet and one inch and by increasing the width of that platform from six feet to six feet and one inch, the force which is required to restore the side member 56 or the side member 66 or the foot member 46 to the position of FIG. 1 is reduced from approximately forty pounds to approximately twenty-five pounds. Increases of more than one inch in the length and width of platform 86 will further reduce the force which is required to restore the side member 56 or the side member 66 or the foot member 46 to the position of FIG. 1—as to values below twenty-five pounds. However, a force of thirty-five pounds or less is believed to be acceptable.

Where a large plastic sheet is substituted for the protective enclosure 88, it is possible to smooth the sides and foot of the cover 108 of FIG. 1 even when only the foot member 46 and one of the side members 56 and 66 are moved outwardly away from the mattress 106. The resulting outward bowing of the exposed foot and side of that mattress will permit the other side of that mattress to be shifted away from the other side member as the other side of cover 108 is smoothed into engagement with that other side of that mattress. Consequently, where a large plastic sheet is substituted for the protective enclosure 88, it would be possible to make the water bed of FIG. 1 with only one movable side member and with a standard board-like rail for the other side member. Such a water bed would not be preferred; because the user would have to push the side of mattress 106 away from that board-like rail prior to, and possibly during, the smoothing of the adjacent side of cover 108, whereas the side members 56 and 66 of FIG. 1 can obviate all need of any such pushing.

By making the platform 86 at least one inch longer than standard length, and by making that platform one inch wider than standard width, it would be possible to make the water bed of FIG. 1 with only one movable side member, with a standard board-like foot member, and with a standard board-like rail for the other side member. Such a water bed would not be preferred; because the user would have to push the foot and the side of mattress 106 away from that board-like foot member and away from that board-like rail prior to, and possibly during, the smoothing of the foot and adjacent side of cover 108, whereas the foot member 46 and the side members 56 and 66 of FIG. 1 can obviate all need of any such pushing.

By providing the protective enclosure 88, the present invention avoids the need of a large plastic sheet such as the sheet 126 of FIG. 7. Also, by providing that protective enclosure, the present invention relieves the user of the water bed of all need of applying appreciable force to restore any of the members 46, 56 and 66 to its normal vertical position. As a result, it is preferred to use a protective enclosure such as the protective enclosure 88.

However, where a user wishes to avoid the cost of a protective enclosure, the construction of FIG. 7 is very useful. Not only does it avoid flexing of the plastic sheet 126, but it materially reduces the force which must be applied to raise either side member or the foot member to its normal vertical position.

In the event, however, that a water bed of moderate cost was required, a bed with the confining frame of FIG. 1 could be equipped with a large plastic sheet such as the plastic sheet 126 of FIG. 7. In the event a water bed of still less cost was required, a bed could be provided with just one movable side member 56 or 66, and with a fixed or movable foot member.

In homes where the occupants like to use thick blankets and comforters, and where the mattress-confining and water-confining actions of enclosure 88 are desired, the waterbed of FIG. 7 can be equipped with an enclosure 88 rather than with the large plastic sheet 126. In such event, the outwardly and downwardly bent upper edges 94 and 100 of the halves of that enclosure would overlie the inner edge of the stationary spacer 120 and the inner edge of the stationary spacer at the opposite side of the waterbed; and the outwardly and downwardly bent upper edge 94 would overlie the inner edge of the stationary spacer at the foot of that waterbed. However, those outwardly and downwardly bent upper edges would be spaced inwardly from the inner faces of the spacer 118 and of the counterpart spacers at the opposite side and foot of the waterbed. The resulting spacing would be great enough to easily accommodate thick blankets and comforters plus sheets and bedspreads. Further, the spaces at the outer face of stationary spacer 120 and at the outer faces of its counterpart stationary spacers at the opposite side and foot of the waterbed would readily accommodate the sides and bottoms of thick blankets and comforters plus sheets and bedspreads. As a result, a combination of the enclosure 88 of FIGS. 1–4 with the stationary and movable spacers of FIG. 7 would provide a waterbed which offers the user thereof the greatest amount of freedom in selecting and using different weights and thicknesses of covers, offers the least resistance to movement of the upper portions of the side members and foot member to their normal vertical positions, and offers the maximum protection against damage down by leaks in the water-filled mattress.

Referring particularly to FIG. 8, the numeral 134 denotes a post of a further embodiment of water bed which is provided by the present invention. The numeral 136 denotes an L-shaped bracket with vertically spaced, hinge-type sleeves at the opposite edges thereof. That bracket is secured to the post 134 by screws. A hinged foot member 138 is movable relative to the post 134, and it has one end thereof confronting that post. A hinged side member 140 is movable relative to that post, and it has one end thereof confronting that post. The hinged foot member 138 bears a hinge-like plate 142 which is dimensioned to cooperate with the hinge-type sleeves at the left-hand edge of bracket 130 to accommodate a hinge-like pin 146. When that pin is set within those sleeves of bracket 136 and the sleeve of plate 142, the foot member 138 will be locked in its vertical position. A hinge-like plate 144 is secured to the hinged side member 140; and when a hinge-like pin 148 is set within the hinge-like sleeves at the right-hand edge of bracket 136 and the sleeve of plate 144, that side member will be held in vertical position. The insertion and removal of the pins 146 and 148 is easily accomplished; and hence the bracket 136 and the plates 142 and 144 can perform the functions of the pivoted latches 48 and 60 of FIGS. 1 and 6.

Referring particularly to FIG. 9, the numeral 152 denotes a post of a further embodiment of water bed which is provided by the present invention. A bracket 154 has flat portions that are displaced from each other by ninety degrees and that are displaced lengthwise relative to each other. One of those portions abuts one face of post 152 and has an opening 156 therein; and the other of those portions abuts an adjacent face of that post and has an opening 158 therein. A pivoted foot member 160 is equipped with an L-shaped slide bolt 164 that can seat within the opening 156; and a pivoted side member 162 is equipped with an L-shaped slide bolt 166 that can seat within the opening 158. Those slide bolts can be used to secure foot member 160 and side member 162 in their normal vertical positions or can free those members for movement outwardly and downwardly away from those positions. The shifting of the slide bolts 164 and 166 between latching and unlatching positions is easily accomplished; and hence the bracket 154 and the slide bolts 164 and 166 can perform the functions of the pivoted latches 48 and 60 of FIGS. 1 and 6.

The movable side members and foot members which are provided by the present invention are desirable and useful, because they free the user from cracked and broken finger nails and from abraded or scratched fingers and hands. In addition, they are desirable and useful because they facilitate the draping and smoothing of covers for a water bed which are equivalent to the draping and smoothing of covers on standard mattresses.

If desired, the hinges 44, 54, 64 and 114 could be made to permit the movable side members and foot members to be moved outwardly and downwardly into positions wherein they are vertical and lie in planes that are parallel to the planes in which those side members and foot members normally lie. Alternatively, if desired, those hinges could be made so those side members and foot members could be moved less than one hundred and eighty (180) degrees outwardly and downwardly from their normal positions. However, those hinges must be made to permit the side members and foot members to be moved far enough outwardly and downwardly to provide ready access to the adjacent sides of the water-filled mattress.

The present invention decreases the amount of time required to "make" a waterbed, as well as protecting the fingernails, fingers and hands of the person "making" that waterbed. Instead of having to work one's way along the entire length of one side of the bed, along the full width of the foot of that bed, and then along the entire length of the opposite side of that bed in increments of one or two hands wide, as must be done in "making" a standard waterbed, the user of the waterbed of the present invention can lower the upper portions of the side and foot members, smooth the sides and end of the cover with unimpeded sweeping hand movements, and then return those upper portions to their normal upper positions. In most instances, a user of the waterbed should be able to "make" that waterbed in far less time—frequently less than one-half of the time—than is required to "make" a standard waterbed.

Whereas the drawing and accompanying description have shown and described several preferred embodiments of the present invention, it should be apparent to those skilled in the art that various changes may be made in the form of the invention without affecting the scope thereof.

What we claim is:

1. A support for a waterbed mattress which comprises a generally horizontal platform, a confining side which is adjacent one side of said platform and which extends upwardly above the level of the upper surface of said platform, a second confining side which is adjacent the opposite side of said platform and which extends upwardly above the level of said upper surface of said platform, said platform and the first said confining side and said second confining side coacting to help define a space for a substantially dimensionally-stable, water-filled mattress which will rest upon said platform and which will have one side thereof and an opposite side thereof confined by said first said confining side and said second confining side, and one of said confining sides having at least a portion thereof which is mechanically independent of and is not secured to and which is selectively and bodily movable toward or away from the adjacent side of a substantially dimensionally-stable, water-filled mattress resting on said platform to support the adjacent side of such a substantially dimensionally-stable, waterfilled mattress and also to apply frictional forces to the edges of a cover which is interposed between said one confining side and the adjacent side of such a substantially dimensionally-stable, water-filled mattress or to expose the adjacent side of such a substantially dimensionally-stable, water-filled mattress and thereby facilitate the positioning and smoothing of an edge of a cover for the adjacent side of such a substantially dimensionally-stable, water-filled mattress in smooth arrangement between the adjacent side of such a substantially dimensionally-stable, water-filled mattress and the inner face of said portion of said one of said confining sides.

2. A support as claimed in claim 1 wherein said one confining side extends parallel to and is hinged to a rail, wherein said one confining side is pivoted outwardly relative to said rail and away from the adjacent side of such a substantially dimensionally-stable, water-filled mattress to facilitate the positioning of the edge of the cover between the adjacent side of such a substantially dimensionally-stable, water-filled mattress and said inner face of said portion of said one of said confining sides, and wherein said one confining side is pivoted inwardly and toward the adjacent side of such a substantially dimensionally-stable, water-filled mattress to coact with the adjacent side of such a substantially dimensionally-stable, water-filled matress to apply frictional holding forces to the edge of the cover.

3. A support as claimed in claim 1 wherein a latch releasably holds said one of said confining sides in position adjacent the adjacent side of such a substantially dimensionally-stable, water-filled mattress and wherein said latch can free said one of said confining sides for movement away from the adjacent side of such a substantially dimensionally-stable, water-filled mattress.

4. A support as claimed in claim 1 wherein such a substantially dimensionally-stable, water-filled mattress exerts a laterally-directed force against said one confining side which is less than thirty-five pounds.

5. A support as claimed in claim 1 wherein said portion of said one confining side has a height which is substantially equal to the height of such an adjacent side of such a water-filled mattress.

6. A support for a waterbed mattress which comprises a generally horizontal platform, a confining side which is adjacent one side of said platform and which extends upwardly above the level of the upper surface of said platform, a second confining side which is adjacent the opposite side of said platform and which extends upwardly above the level of said upper surface of said platform, said platform and the first said confining side and said second confining side coacting to help define a space for a substantially dimensionally-stable, water-filled mattress which will rest upon said platform and which will have one side thereof and an opposite side thereof confined by said first said confining side and said second confining side, and one of said confining sides having at least a portion thereof which is mechanically independent of and is not secured to and which is selectively and bodily movable toward or away from the adjacent side of a substantially dimensionally-stable, water-filled mattress resting on said platform to support the adjacent side of such a substantially dimensionally-stable, water-filled mattress and also to apply frictional forces to the edges of a cover which is interposed between said one confining side and the adjacent side of such a substantially dimensionally-stable, water-filled mattress or to expose the adjacent side of such a substantially dimensionally-stable, water-filled mattress and thereby facilitate the positioning and smoothing of an edge of a cover for the adjacent side of such a substantially dimensionally-stable, water-filled mattress in smooth arrangement between the adjacent side of such a substantially dimensionally-stable, water-filled mattress and the inner face of said portion of said one of said confining sides, such a substantially dimensionally-stable, water-filled mattress being a standard-size substantially dimensionally-stable, waterbed mattress, and said platform being larger than a standard-size waterbed platform, whereby such a substantially-dimensionally-stable, water-filled mattress exerts a substantially smaller laterally-directed force against said one confining side than such a substantially dimensionally-stable, waterbed mattress exerts against either confining side of a standard-size waterbed.

7. A support for a waterbed mattress which comprises a generally horizontal platform, a confining side which is adjacent one side of said platform and which extends upwardly above the level of the upper surface of said platform, a second confining side which is adjacent the opposite side of said platform and which extends upwardly above the level of said upper surface of said platform, said platform and the first said confining side and said second confining side coacting to help define a space for a water-filled mattress which will rest upon said platform and which will have one side thereof and an opposite side thereof confined by said first said confining side and said second confining side, one of said confining sides having a stationary portion which is in register with the lower portion of an adjacent side of a water-filled mattress adapted to rest on said platform to confine such a lower portion and to withstand laterally-directed forces applied by such a lower portion, said one confining side having a movable portion which is disposed, at least in part, above the level of said stationary portion and which is in register with an upper portion of the adjacent side of such a water-filled mattress and which normally confines such an upper portion of such an adjacent side and normally withstands laterally-directed forces applied by such an upper portion of such an adjacent side, and said movable portion of said one confining side being movable away from such an upper portion of such an adjacent side of such a water-filled mattress to facilitate the positioning of a cover for such a water-filled mattress adjacent such an upper portion of such an adjacent side of such a water-filled mattress.

8. A support as claimed in claim 7 wherein said movable portion of said one confining side selectively engages a portion of such a cover to tend to hold such a portion of such a cover in position relative to such an upper portion of such an adjacent side of such a water-filled mattress.

9. A support as claimed in claim 7 wherein the upper edge of said stationary portion and a confronting edge of said movable portion of said one confining side coact to define a space which can accommodate part of one side of such a cover.

10. A support as claimed in claim 7 wherein said stationary portion can support a thin impervious sheet of plastic material that can hold and confine water which leaks from such a water-filled mattress.

* * * * *